US005820572A

United States Patent [19]

Palmer

[11] Patent Number: 5,820,572

[45] Date of Patent: Oct. 13, 1998

[54] NEGATIVE PRESSURE CHEST BRACE

[75] Inventor: Charles Palmer, Hummelstown, Pa.

[73] Assignee: The Penn State Research Foundation, University Park, Pa.

[21] Appl. No.: 560,267

[22] Filed: Nov. 21, 1995

[51] Int. Cl.[6] ..... A61H 31/00

[52] U.S. Cl. ..... 601/41; 601/44; 602/19

[58] Field of Search ..... 601/1, 41–44, 601/106–108, 134, 155; 602/6, 19; 2/44, 45, 92

[56] References Cited

U.S. PATENT DOCUMENTS

| | | | |
|---|---|---|---|
| 201,038 | 3/1878 | Mosher | 601/23 |
| 2,529,258 | 11/1950 | Lobo | 601/44 |
| 2,833,275 | 5/1958 | Tunnicliffe | 601/44 |
| 3,941,120 | 3/1976 | Lee . | |
| 4,187,277 | 2/1980 | Quinlan . | |
| 4,257,407 | 3/1981 | Macchi . | |
| 4,371,497 | 2/1983 | Quinlan . | |
| 4,425,920 | 1/1984 | Bourland et al. . | |
| 4,523,579 | 6/1985 | Barry . | |
| 4,669,461 | 6/1987 | Battaglia et al. . | |
| 4,770,164 | 9/1988 | Lach et al. . | |
| 4,770,165 | 9/1988 | Hayek . | |
| 4,815,452 | 3/1989 | Hayek | 601/44 |
| 4,881,527 | 11/1989 | Lerman . | |
| 4,915,095 | 4/1990 | Chun . | |
| 4,945,899 | 8/1990 | Sugiyama et al. . | |
| 4,971,042 | 11/1990 | Lerman . | |
| 4,977,889 | 12/1990 | Budd . | |
| 4,982,735 | 1/1991 | Yagata et al. . | |
| 5,076,259 | 12/1991 | Hayek . | |
| 5,107,830 | 4/1992 | Younes . | |
| 5,362,304 | 11/1994 | Varn . | |
| 5,487,889 | 1/1996 | Eckert et al. | 604/304 |
| 5,549,914 | 8/1996 | Farber | 424/487 |

FOREIGN PATENT DOCUMENTS

| | | | |
|---|---|---|---|
| 653794 | 10/1992 | Australia | 601/41 |
| 509773 | 10/1992 | European Pat. Off. | 601/41 |
| 1225560 | 4/1986 | U.S.S.R. | 602/19 |
| 1247009 | 7/1986 | U.S.S.R. | 601/44 |

*Primary Examiner*—Jeanne M. Clark
*Attorney, Agent, or Firm*—Thomas J. Monahan

[57] ABSTRACT

A chest brace apparatus prevents the chest wall from buckling inwards during spontaneous breathing efforts and provides negative distending intra-thoracic pressure to a patient. The apparatus includes a protective adhesive layer placed on the patients skin and a brace structure that is designed to attach to the adhesive layer. The adhesive layer has an inner surface and an outer surface, the inner surface adapted to adhere to a chest region of the patient and the outer surface manifesting an outer adherent layer for attachment to the brace structure. The brace structure is placed about the patient's chest region and includes a frontal resilient segment with a patient-side adherent layer for joinder to the outer surface of the adhesive layer, and flexure strips connected to the frontal resilient segment for imparting an outward flexure thereon so as to distend the patient's chest region by outward pressure exerted on the adhesive layer. A pneumatically operated extension device can be connected to the frontal resilient segment for control of distension thereof in response to a pneumatic control action. The brace structure is further adapted to enable manual distension or compression of the thoracic contents.

5 Claims, 6 Drawing Sheets

NEGATIVE PRESSURE CHEST BRACE

FIELD OF THE INVENTION

This invention relates to a chest brace for providing both rigidity and a continuous outward pull on the chest wall of a neonate to keep the lungs inflated and, more particularly, to an inexpensive chest brace which applies a continuous outward pull on the chest via interaction with skin covering the chest, rather than through applied negative air pressure.

BACKGROUND OF THE INVENTION

Pulmonary insufficiency associated with immaturity is one of the most common life-threatening hurdles that confronts the premature newborn baby. The newborn's rib cage is soft and buckles easily during spontaneous respiration. Underdevelopment of the intercostal muscles contributes to the chest's deformability. In premature infants below 30 weeks gestation, thoracic wall elastic recoil is almost nonexistent so that the resting volume of the lungs is very close to or below their collapsed volume. Also, the compliant chest wall tends to collapse as the diaphragm descends, resulting in a diminished tidal volume. As a result, most premature infants require assisted ventilation and/or continuous distending pressure (CDP).

Continuous positive airway pressure (CPAP) is widely established as an effective method for preventing lung wall collapse, chest wall distortion and for increasing oxygenation. Currently, CPAP is used almost exclusively in preference to continuous negative distending pressure. CPAP, however, is potentially hazardous. It is usually administered by nasal prongs, but has major limitations and serious side effects. These include: nasal trauma; difficulty in obtaining a good fit in very small infants; high gas flows which cause cooling, drying and obstruction of the nasal passages; during periods of crying and mouth opening, especially with high flows, there is a loss of pressure and the infant inhales room air; and frequent dislodgement makes nursing difficult, especially when associated with repeated bouts of desaturation. Fluctuating saturation may increase the risk of retinopathy. Perhaps more serious are the circulatory disturbances: decreased venous return to the heart; diminished cardiac output; and increased intra-cranial hemorrhage.

Negative pressure applied intermittently around the chest has been used for more than a 100 years as a way of assisting ventilation in patients with respiratory failure. The iron lung is perhaps one of the best recognized negative pressure ventilators. Continuous negative distending pressure (CNP) is used to manage a number of specific conditions that produce respiratory failure in neonates and older infants. Negative distending pressure is highly effective and does not have many of the side effects of CPAP. Among its benefits with patients with respiratory disease syndrome are an increase in resting volume of the lung and arterial oxygen tension. There is also no need for an airway or nasal prongs. As opposed to positive distending pressure, CNP produces a decrease in intrathoracic and right atrial pressures, favoring venous return to the heart from parts of the body that are not exposed to the negative pressure. CNP further increases lung lymph flow and lung albumen transport. CNP also avoids the increases in pulmonary vascular resistance and pulmonary artery pressure that are observed with positive airway pressure. Recently, CNP has been re-introduced to treat infants with various pathological conditions.

While improvements have been made in the design of devices for generating extra-thoracic negative pressure, the devices are still difficult to attach to small newborns. Current designs consist of a cuirass or chamber and use vacuum around the chest or lower body to generate negative pressure. These devices require some form of electrical power supply, are relatively expensive and are cumbersome. Technical difficulties are associated with temperature control, neck seals obstructing venous return, leaks around the seals and limited patient access. These devices require considerable training and experience to operate and the technical problems make nursing difficult and frustrating. This limits the use of a potentially life saving treatment modality.

Providing and caring for ever-diminishing-size pre-term infants is an everyday challenge in the neonatal intensive care setting.

Accordingly, it is an object of this invention to provide a chest brace which enables continuous negative distending intra-thoracic pressure to be applied to a patient.

It is a further object of this invention to provide a chest brace which reduces buckling (retraction) of a patient's chest wall during breathing..

It is another object of this invention, to provide a chest brace which provides continuous negative pressure on the patient's chest cavity without requiring vacuum seals.

It is yet another object of this invention to provide an improved continuous negative pressure chest brace which is particularly adapted for use with premature newborn babies.

It is still another object of this invention to provide an improved chest brace that is simple to attach, inexpensive and does not require electrical power.

It is still a further object of this invention to provide an improved chest brace which is adapted to provide intermittent negative pressure ventilation for a patient without a need for endotracheal intubation.

SUMMARY OF THE INVENTION

A chest brace apparatus prevents the chest wall from buckling inwards during spontaneous breathing efforts and provides negative distending intra-thoracic pressure to a patient. The apparatus includes a protective adhesive layer placed on the patients skin and a brace structure that is designed to attach to the adhesive layer. The adhesive layer has an inner surface and an outer surface, the inner surface adapted to adhere to a chest region of the patient and the outer surface manifesting an outer adherent layer for attachment to the brace structure. The brace structure is placed about the patient's chest region and includes a frontal resilient segment with a patient-side adherent layer for joinder to the outer surface of the adhesive layer, and flexure strips connected to the frontal resilient segment for imparting an outward flexure thereon so as to distend the patient's chest region by outward pressure exerted on the adhesive layer. A pneumatically operated extension device can be connected to the frontal resilient segment for control of distension thereof in response to a pneumatic control action. The brace structure is further adapted to enable manual distension or compression of the thoracic contents.

DETAILED DESCRIPTION OF THE INVENTION

Figure 1:
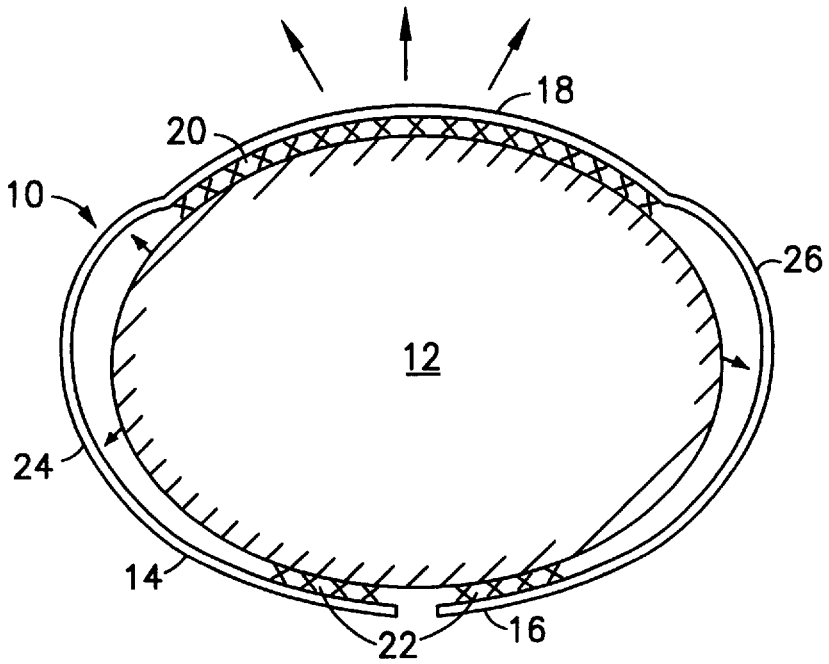
FIG. 1 is a schematic cross-section of a patient's chest showing a chest brace apparatus which incorporates the invention hereof.

The chest brace 10 incorporating the invention hereof is shown schematically in FIG. 1 and comprises a resilient metal core which is bent to surround a patient's chest 12 (shown in cross-section). Chest brace 10 includes a pair of arms 14 and 16 which are bent around chest 12. A frontal resilient segment 18 is adhered to the patient's chest wall by an adhesive structure 20 whose details will be described below. In similar fashion, arms 14 and 16 are adhered to the patient's back via an adhesive structure 22. The lateral segments 24 and 26 of chest brace 10 are not adhered to the patient's chest wall thereby enabling lateral expansion and contraction during breathing.

Chest brace 10, when in the position shown in FIG. 1, exerts an outward distending force (via adhesive structure 20) on the skin of the patient's chest. The distending force is accomplished by assuring that the resilient metal core assumes an approximately oval shape when arms 14 and 16 are bent around the patient, the oval shape being such as to cause a separation of frontal resilient segment 18 from the patient's chest wall. After the arms 14 and 16 have been adhered to the patient's back, a pressure is applied to frontal resilient segment 18, causing it to adhere to the patient's chest wall. The resiliency and inherent recoil of the compressed metal core causes an outward flexure of frontal resilient segment 18, and a continuous distending force upon the patient's chest wall.

Figure 2:
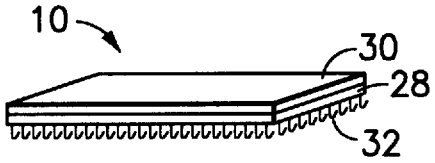
FIG. 2 shows a section of the chest brace and illustrates its respective components.

Referring to FIG. 2, a small section of chest brace is shown and illustrates that resilient metal core 28 is sandwiched between a soft material layer 30 and a Velcro™ layer 32. Velcro layer 32 only extends over the length of chest brace 10 which makes contact with a mating layer of Velcro that has been adhered, by an intermediate adhesive layer, to the patient's chest wall.

Figure 3:
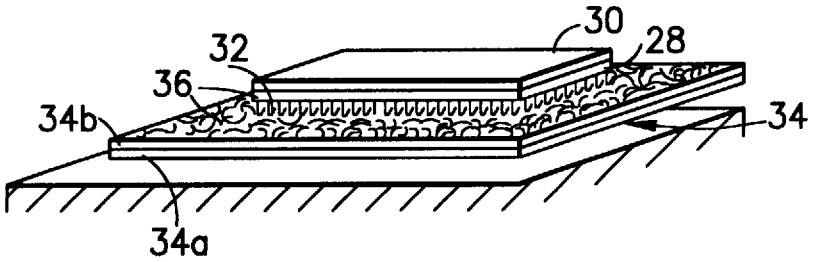
FIG. 3 illustrates a section of the chest brace that has adhered to a protective-adhesive strip which is bonded to the patient's chest.
Figure 4:
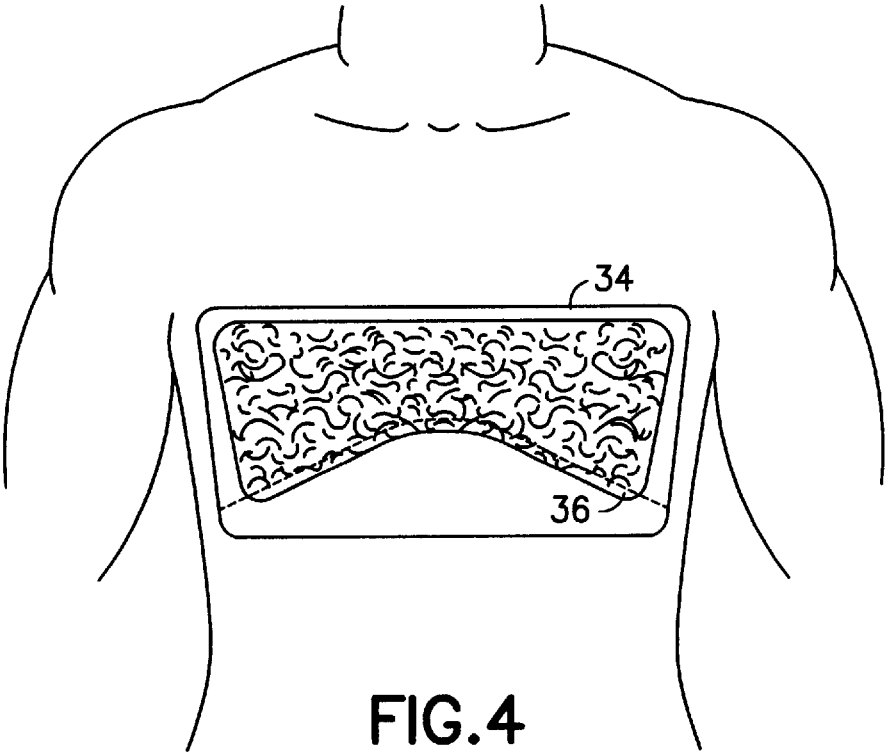
FIG. 4 is an anterior chest view of a patient showing the site of application of the protective-adhesive strip.

The Velcro/adhesive layer is shown in further detail in FIG. 3 and is comprised of a thin, elastic, transparent and self-adhesive hydrocolloid layer 34. Such materials are often used as a sterile skin dressing in neonatal intensive care units to protect newborn skin. Such materials consist of liquid absorbing particles in an elastic, self-adhesive mass 34*a*, covered on one side by a semi-permeable elastic and non-adherent polyurethane film 34*b*. The principal ingredients of such a hydrocolloid dressing are sodium carboxymethyl cellulose, synthetic block co-polymer, artificial tackifier and a plasticizer. Such a hydrocolloid material is manufactured by Coloplast, Inc., Tampa, Fla., and is marketed under the trademark COMFEEL™.

Adhered to film surface 34*b* of hydrocolloid layer 34 is a further layer of Velcro 36. Velcro layer 36 may be of the loop variety and Velcro layer 32 of the hook variety (or vice-versa) to enable a joinder therebetween. While the attachment mechanism is most preferably accomplished by the described, interacting Velcro layers, those skilled in the art will realize that any instrumentality which enables an adhesion between the patient's chest wall and the inner surface of chest brace 10 is within the scope of the invention.

Resilient metal core 28 is preferably comprised of strips of thin steel (e.g. 0.007–0.001 shim steel). The metal strips (or strip) are encased on their outer side with a soft material (such as moleskin™, available from the Johnson & Johnson Company, New Brunswick, N.J.), and on their inner surface with Velcro layer 32. The thickness of each metal core 28 can be changed to suit the needs and dimensions of the patient. For example, an infant weighing 1,500 grams may need a chest brace 10 made of two steel strips, with each steel strip being approximately ¼ inch wide, thereby making the brace a little more than ½ inch wide.

FIGS. 4–7 illustrate the method of application of chest brace 10 to a patient. A strip of self-adhesive loop Velcro 36 is centered on the top of hydrocolloid layer 34 on the patient's anterior chest wall. Velcro 36 extends between the anterior axillary lines and a similar Velcro strip 40 is placed over hydrocolloid layer 42 posteriorly between the patient's scapulas (see FIG. 6).

Figure 5:
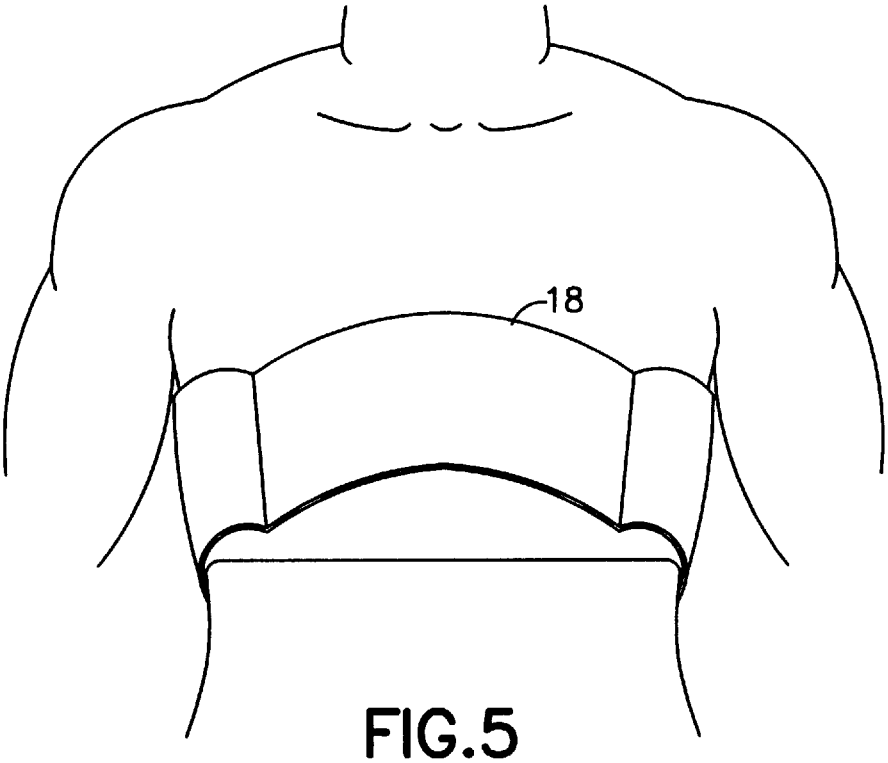
FIG. 5 is an anterior chest view showing the placement of the chest brace over the patient's chest.
Figure 6:
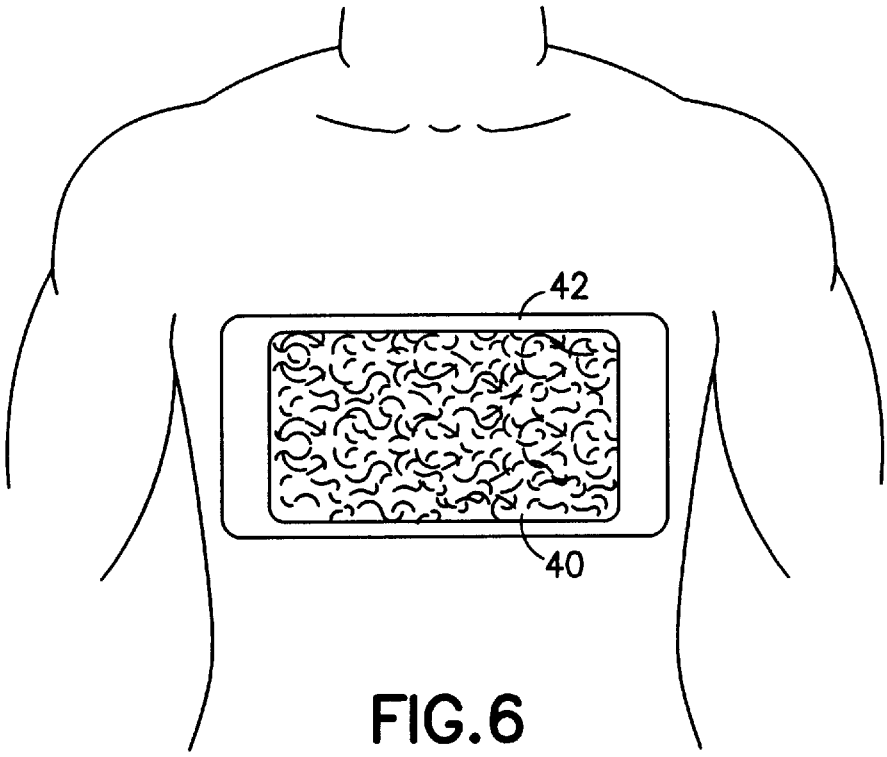
FIG. 6 is a posterior view of the patient to show placement of an adhesive strip thereon.
Figure 7:
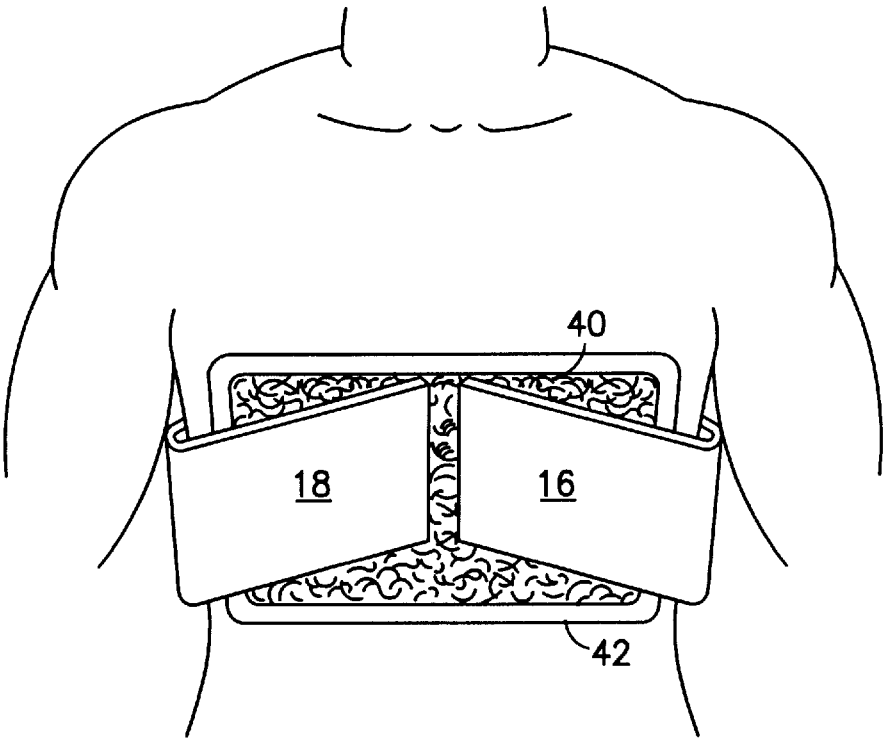
FIG. 7 is a posterior view of the patient showing two sides of the chest brace adhering to the adhesive strip of FIG. 6.

With the patient in the supine position, arm 16 of chest brace 10 (see FIG. 7) is first brought into contact with velcro layer 40 and is joined thereto by the corresponding Velcro layer on arm 16. Chest brace 10 is then swung anteriorly so as to encircle the patient's chest, arching over the xiphisternum and leaving at least ½ inch space between Velcro layer 36 on the patient's chest (see FIG. 4) and Velcro layer 32 on the underside of the resilient segment (see. FIG. 5). The free end of the chest brace 10 (e.g. arm 18) is then attached onto Velcro layer 40, that is adhered to the patient's back by hydrocolloid layer 42.

Frontal resilient segment 18, positioned above the patient's sternum, is then indented by finger pressure so that the complementary Velcro layers lock together. It is preferred to have resilient segment 18 adhere to as much of anterior chest Velcro 36 as possible to disperse the load on the skin and the subcutaneous tissue. Once indented, the inherent recoil in the steel core exerts an outward pull on the chest wall. Sides 24 and 26 of the chest brace 10 are not attached to the patient and act as levers which pull out the chest anteriorly.

Figure 8:
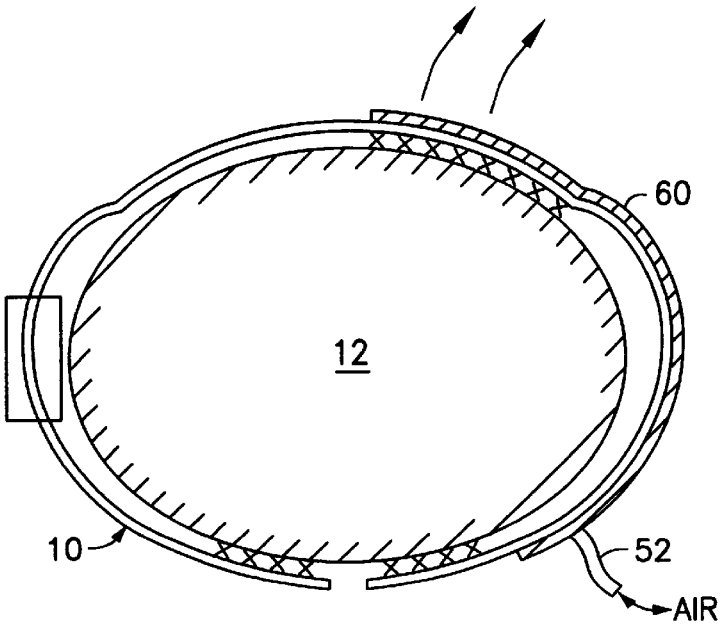
FIG. 8 is a cross-section of the patient with a chest brace which includes a pneumatic tube for providing active negative pressure ventilation to the patient.

In addition to providing rigidity for the patient's chest wall and a continuous negative distending pressure, chest brace 10 is also adapted to provide active ventilation. Referring to FIG. 8, the exterior surface of chest brace 10 includes an air bladder 50 which is bonded thereto. By controlling the amount of air within air bladder 50, via tube 52, the stiffness of bladder 50 can be altered to control the amount of outward pull of chest brace 10. More specifically, filling bladder 50 with air changes its shape, and as bladder 50 straightens, it pulls the brace away from the chest. When pressure is released from air bladder 50, chest brace 10 is enabled to resume its original position by the natural resiliency of its metal core. In such manner, ventilation of the patient can be assisted by periodically altering the air pressure within air bladder 50.

Figure 9:
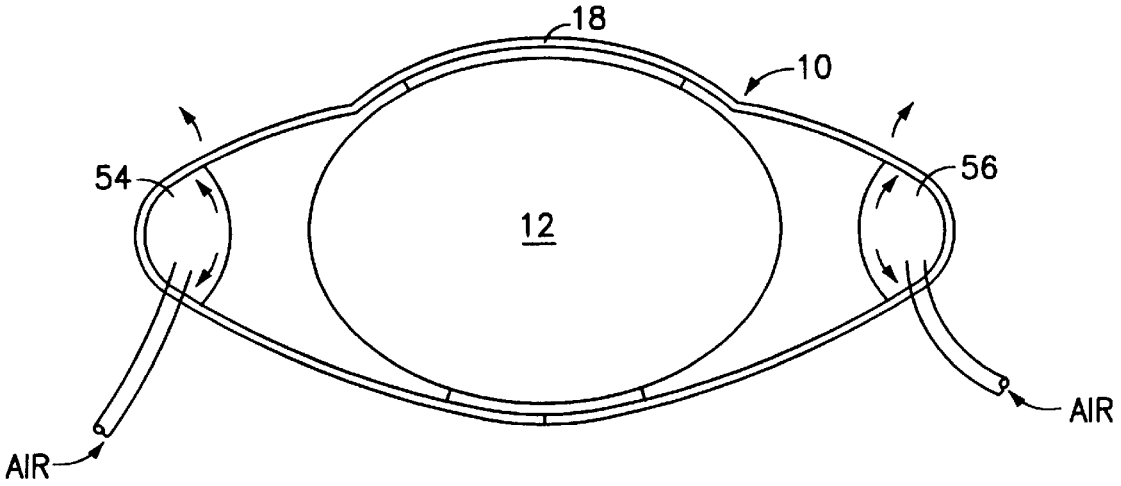
FIG. 9 shows a cross-section of a brace on a patient's chest and includes interior distendable balloons for providing controllable negative pressure ventilation to the patient.

In FIG. 9, a similar ventilation structure is shown, however, in this case, a pair of air bladders 54 and 56 are positioned within chest brace 10 and upon inflation and deflation, control the position of frontal resilient segment 18 of chest brace 10. In such manner, ventilation of the patient is assisted.

Figure 10:
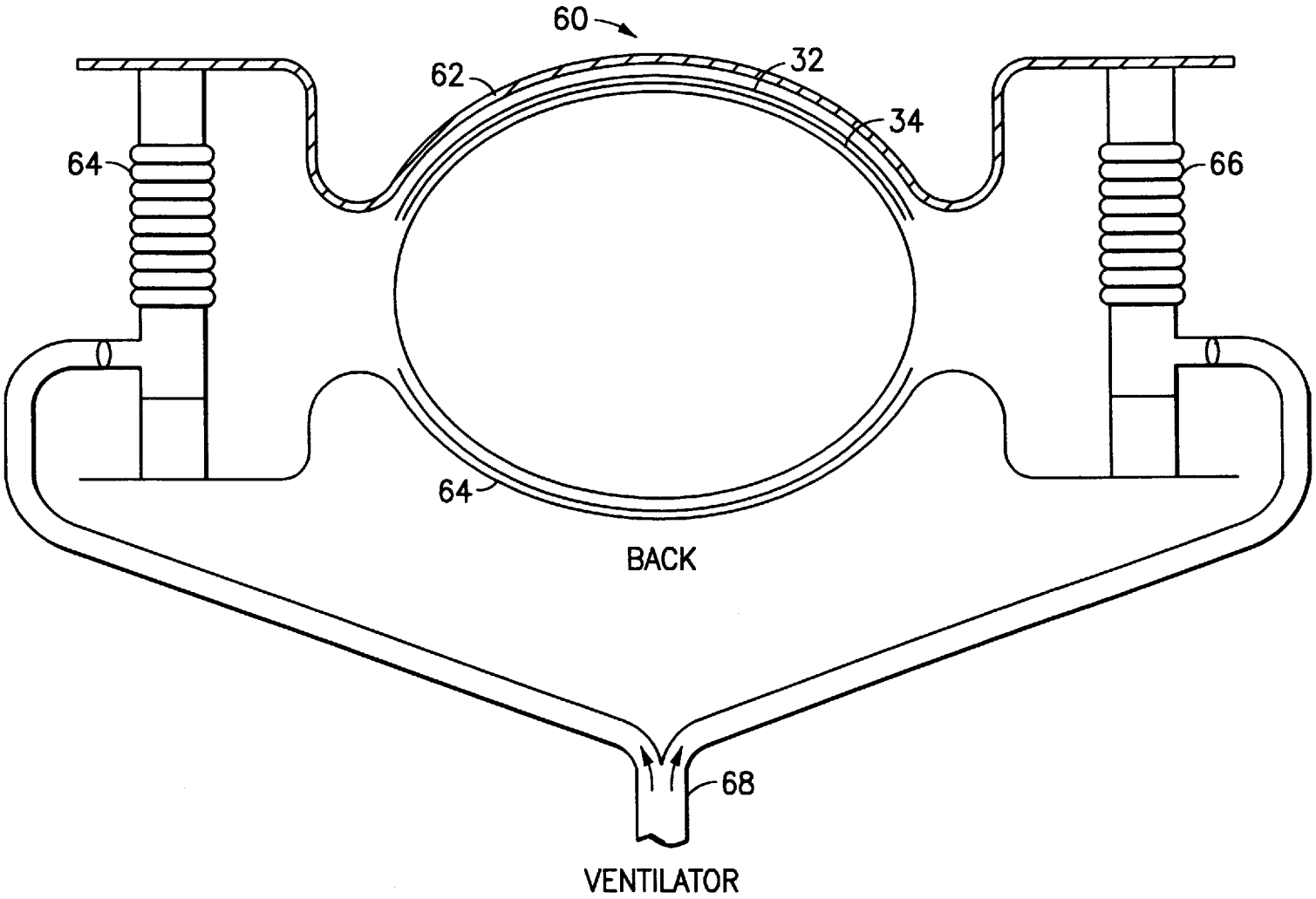
FIG. 10 is a cross-section of a further embodiment of the chest brace showing the use of corrugated tubing for imparting controllable negative pressure ventilation to the patient.

In FIG. 10, a further embodiment of a chest brace is shown, however, in this case, chest brace 60 comprises a pair of separated brace members 62 and 64. Anterior brace member 62 is adhered to the patient's chest wall via the same connection mechanism as described above. Similarly, posterior brace member 62 is adhered to the back of the patient in the manner described above. The spacing between brace members 62 and 64 is controlled by air pressure within a pair of corrugated respirator tubes 64 and 66. Thus, as pressure is increased within corrugated tubes 64 and 66, anterior brace member 62 moves away from posterior brace member 64. Through the action of the Velcro interconnection between anterior brace member 62 and the patient's chest wall, the patient's chest wall moves outwardly. When, however, pressure is reduced within corrugated tubing 64 and 66, a vacuum is created thereby causing a squeezing action on the patient's chest between brace numbers 62 and 64. In such manner, the patient's respiration is assisted. Control of air pressure in tubes 64 and 66 is via an input 68 from a ventilator system which provides the necessary alterations in air pressure.

Figure 11:
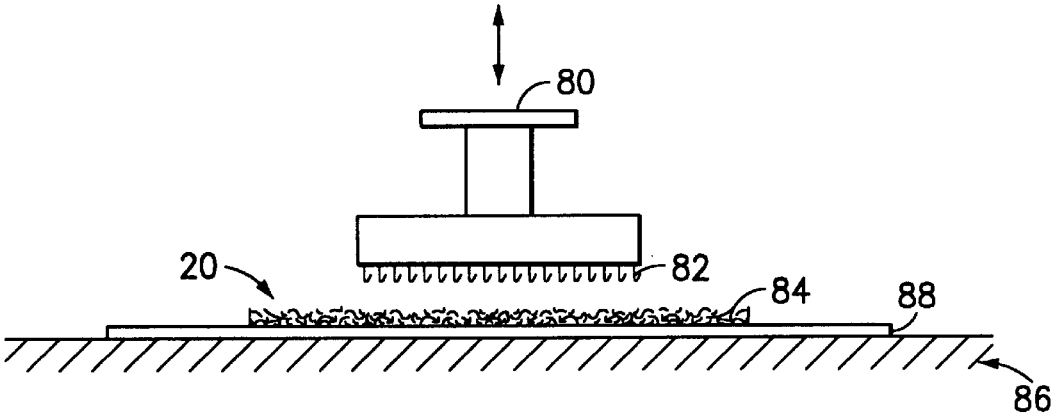
FIG. 11 is a side view of a T-piece which is usable with the protective-adhesive layer to enable manual compression and distension of the chest wall.

The presence of adhesive structure 20 on a patient's chest renders it further possible to manually compress and distend the chest. In FIG. 11, a T-shaped plunger 80 includes a distal layer 82 of Velcro which can attach to Velcro layer 84 that is, in turn, adhered to chest wall 86 by adhesive layer 88. Manual manipulation of plunger 80 allows compression and distension of chest wall 86.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. Chest brace apparatus for providing negative distending intra-thoracic pressure to a patient, comprising:

adhesive means having an inner layer and an outer layer, said inner layer having means to adhere to a chest region of a patient and said outer layer manifesting an outer adherent layer; and a brace structure for substantially encircling a patient's body and comprising a resilient strip exhibiting an oval-like shape in a non-stressed state, said resilient strip including (i) a frontal segment with a patient-side adherent layer for joinder to said outer layer of said adhesive means, and (ii) flexure means connected to said frontal segment for imparting an outward flexure to said frontal segment so as to distend a patient's chest region by outward pressure exerted thereon via said adhesive means, thereby creating a negative intra-thoracic pressure, and wherein said frontal segment is displaced from said adhesive means when not adherent thereto, and when adherent thereto, exerts an outward distending force thereon.

2. The chest brace apparatus as recited in claim 1, wherein said flexure means comprises;

a pair of flexible arms which are resilient and extend around lateral extents of a patient's chest region and about a patient's back region, each arm having a distal end; and attachment means for securing each said distal end at said back region of the patient.

3. The chest brace apparatus as recited in claim 2, wherein each said distal end includes an adherent layer and said attachment means comprises;

adhesive means having an inner layer and an outer layer, said inner layer adapted to adhere to a back region of a patient and said outer layer manifesting an outer adherent layer which secures to each adherent layer on each said distal end when brought into contact therewith.

4. The chest brace apparatus as recited in claim 1, wherein said adhesive means includes an hydrocolloid dressing comprising sodium carboxymethyl cellulose, a synthetic block copolymer, an artificial tackifier and plasticizer, and said outer layer thereof comprises a hook and loop fastener.

5. The chest brace apparatus as recited in claim 4, wherein each adherent layer on each said distal end comprises a hook and loop fastener.

* * * * *